United States Patent [19]

Coulston

[11] 4,157,634

[45] Jun. 12, 1979

[54] WEATHERSTRIPPING

[75] Inventor: Ellwin L. Coulston, Niles, Mich.

[73] Assignee: Kawneer Company, Inc., Niles, Mich.

[21] Appl. No.: 899,228

[22] Filed: Apr. 24, 1978

[51] Int. Cl.[2] ..... E06B 7/23

[52] U.S. Cl. ..... 49/485; 49/489

[58] Field of Search ..... 49/485, 489, 475, 380, 49/470, 496, 493

[56] References Cited

U.S. PATENT DOCUMENTS

| | | | |
|---|---|---|---|
| 1,666,328 | 4/1928 | Dennis | 49/496 |
| 1,667,144 | 4/1928 | Dennis | 49/496 X |
| 2,549,284 | 4/1951 | Baker | 49/70 X |
| 2,757,422 | 8/1956 | Flicker | 49/496 X |
| 3,131,441 | 5/1964 | Cornell | 49/493 X |
| 3,140,517 | 7/1964 | Richter | 49/489 |
| 3,788,008 | 1/1974 | Yackiw et al. | 49/496 |
| 3,819,464 | 6/1974 | Ungerer | 49/489 X |
| 4,006,562 | 2/1977 | Belanger et al. | 48/380 |

FOREIGN PATENT DOCUMENTS

| | | | |
|---|---|---|---|
| 2523664 | 12/1976 | Fed. Rep. of Germany | 49/485 |

*Primary Examiner*—Philip C. Kannan

*Attorney, Agent, or Firm*—Mason, Kolehmainen, Rathburn & Wyss

[57] ABSTRACT

An elongated weatherstripping for use with a hingedly mounted closure member such as an entrance door includes a body of flexible material having an inside surface adapted to be secured to a stop element facing an edge portion of the door. The body includes an edge portion projecting laterally outwardly along one edge of the stop element and a deflectable sealing element integrally formed with the body and pivotally joined along an outer edge of the laterally projecting portion in a reverse turn. The sealing element includes an outwardly facing sealing surface which is adapted to seal against the side face of the door when the door is in a closed position. The sealing surface is concave/convex outwardly from the reverse turn toward the closure member with an S-shaped cross-section. The convex portion is deflectable inwardly toward the body upon pivotal movement at the reverse turn resulting from inward contact and sliding lateral contact with the door as it is closed.

14 Claims, 6 Drawing Figures

FIG.1
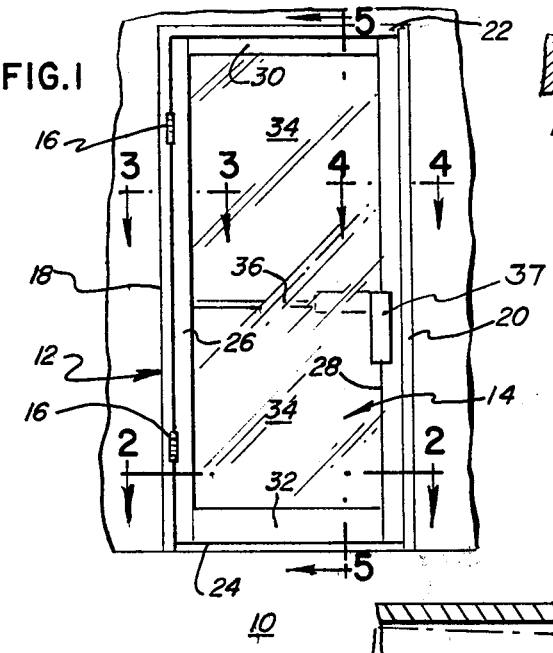
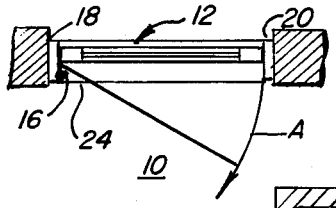
FIG.2
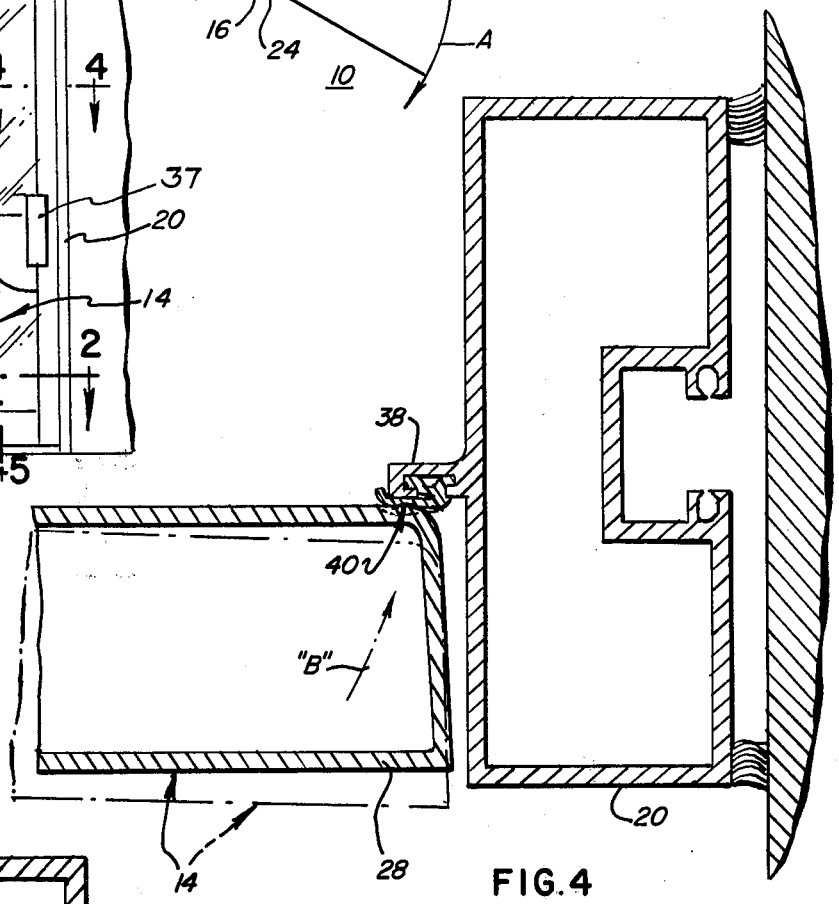
FIG.4
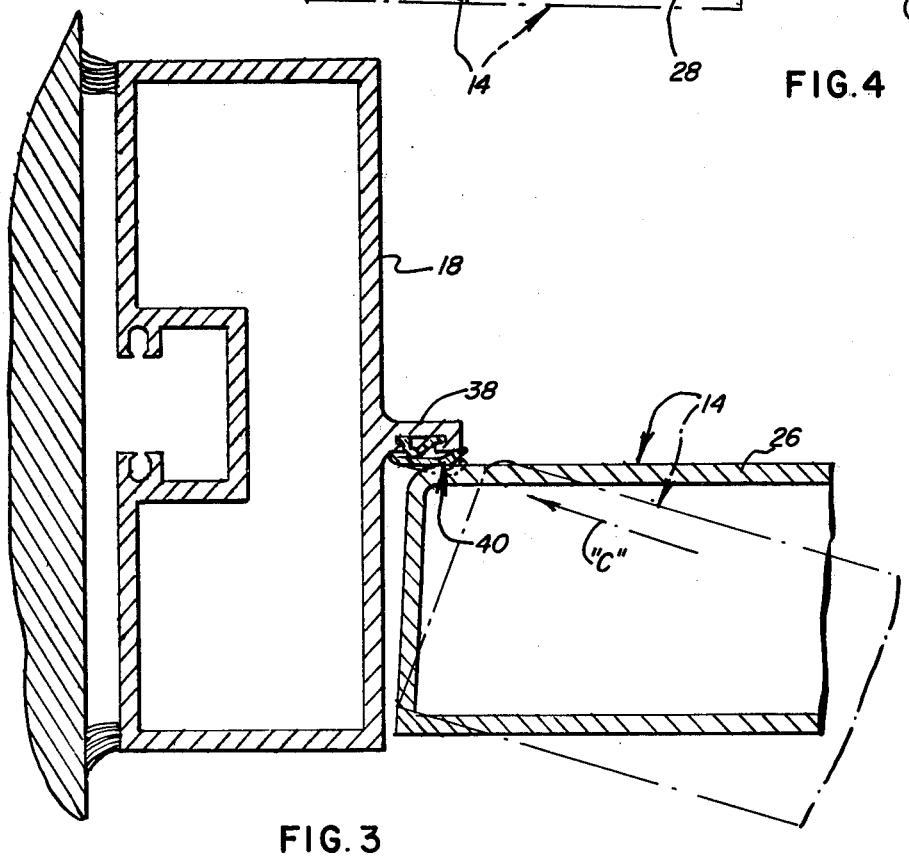
FIG.3

FIG. 5
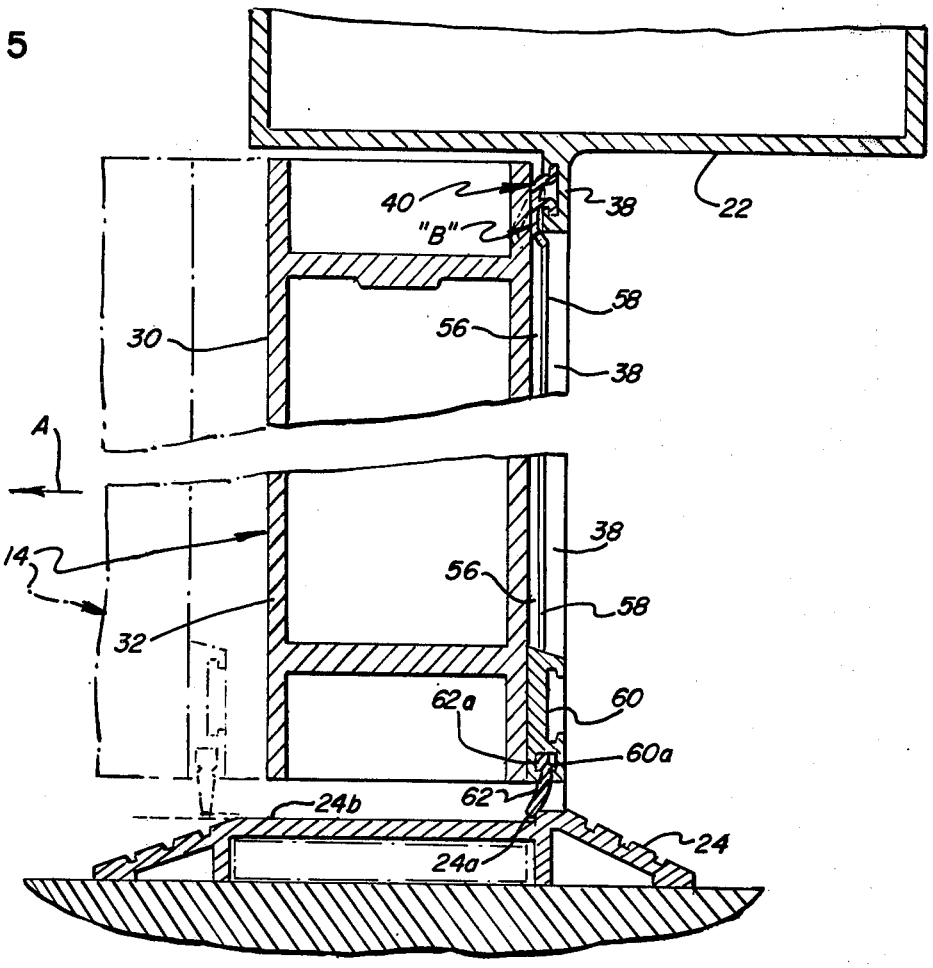
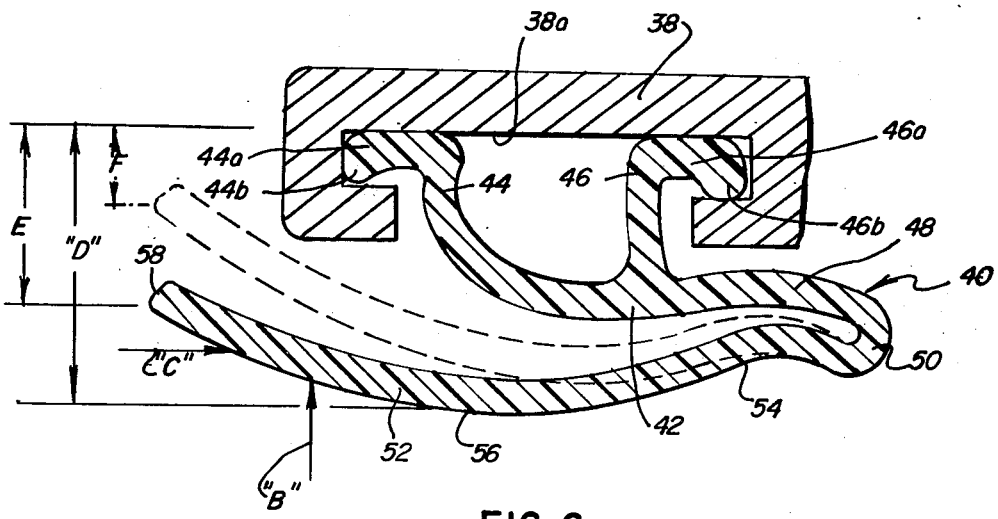
FIG. 6

WEATHERSTRIPPING

BACKGROUND OF THE INVENTION

1. Field of the Invention

The present invention relates to an elongated weatherstripping and more particularly to a weatherstripping adapted to be mounted in a stop element on the periphery of the door frame or the like for sealing engagement with a marginal edge portion of a hinged door.

2. Description of the Prior Art

A wide variety of weatherstripping and sealing elements have been provided for windows, doors and the like. Some of these weatherstrippings are designed for a compressive type seal while others have been designed to function as a wiping or sliding seal. As far as is known, no weatherstripping has been provided wherein excellent sealing characteristics are achieved for both a compression type seal and a wiping or sliding type seal.

Accordingly, it is an object of the present invention to provide a new and improved elongated weatherstripping for doors, windows and the like.

Another object of the invention is to provide a new and improved elongated weatherstripping of the character described which is especially adapted for use with hingedly mounted closure members such as building entrance doors and windows.

Still another object of the present invention is to provide a new and improved weatherstripping which is functional both as a compressive type seal and as a wiping or sliding type seal.

Still another object of the present invention is to provide a new and improved elongated weatherstripping which is especially useful in sealing around the peripheral edge portion of a hingedly mounted door or closure member.

Another object of the present invention is to provide a new and improved weatherstripping which is adapted to be mounted in a surrounding door frame on a stop member thereof for sealing engagement with a movable door or closure member.

Still another object of the invention is to provide a new and improved elongated weatherstripping which is extremely effective in providing a weathertight seal with both a compression type seal and sliding or wiping type seal.

Still another object of the present invention is to provide a new and improved weathertight entrance system wherein a pivoted door is effectively sealed along marginal edge portions of one face thereof.

Yet another object of the present invention is to provide a new and improved weathertight entrance system wherein weatherstripping seals are aligned on a common plane along all edges of the door.

Still another object of the present invention is to provide a new and improved weathertight entrance system employing a novel weatherstripping and threshold combination which forms an effective seal along the bottom of the door.

Yet another object of the present invention is to provide a new and improved weathertight entrance system as described in the preceding paragraphs wherein the weatherstripping along the bottom edge of the door is aligned in a common plane with a different type of weatherstripping adjacent the top and side edges of the door to provide an extremely effective complete peripheral seal around the door when closed.

BRIEF SUMMARY OF THE INVENTION

The foregoing and other objects and advantages of the present invention are accomplished in an illustrated embodiment which comprises an elongated weatherstripping of flexible, resilient, weather resistant material having a body portion with an inside surface adapted to be mounted on a door frame stop element adjacent the facing edge of a pivotally mounted closure member or door. The body portion includes an edge portion which projects laterally outwardly along one edge of the stop element and a deflectable sealing element is integral with the body portion and is pivotally joined thereto along the outer edge of the laterally projecting edge portion in a reverse turn which acts as a hinge between the body and sealing element. The sealing element includes an outwardly facing sealing surface which is adapted to provide both a compression type and a sliding or wiping type seal against a side face of the door when the door is closed with respect to the door stop of the door frame. The sealing surface extends or slopes outwardly from the reverse turn at the edge towards the door and a mid portion thereof is adapted to contact the door when it is closed. The portion adjacent the edge is of an outwardly concave cross-section and the mid portion of the sealing element is of an outwardly convex cross-section. The outwardly convex portion is deflectable inwardly toward the body portion of the weatherstripping when the door is closed as a result of either direct inward compression and/or sliding contact between the door surface and the sealing element. The sealing element includes a free outer edge portion opposite the reverse turn and this portion is deflectable inwardly towards the body of the weatherstripping when the door is closed by a camming or wiping action. The elongated weatherstripping as described is adapted to be mounted in stop elements along the sides and a top or header of the door frame.

Another type of novel sealing element or weatherstripping is mounted on the bottom edge of the door itself to be in coplanar relationship with the weatherstripping on the stop element when the door is closed. This bottom weatherstripping is adapted to sealingly engage an especially designed threshold mounted along the bottom or floor of the entrance to complete the peripheral seal around the door when it is closed.

BRIEF DESCRIPTION OF THE DRAWINGS

FIG. 1 is an outside elevational view of an entrance system embodying the features of the present invention;

FIG. 2 is a horizontal cross-sectional view taken substantially along lines 2—2 of FIG. 1;

FIG. 3 is an enlarged fragmentary, horizontal, cross-sectional view taken substantially along lines 3—3 of FIG. 1;

FIG. 4 is an enlarged, horizontal, cross-sectional view taken substantially along lines 4—4 of FIG. 1;

FIG. 5 is an enlarged vertical cross-sectional view taken substantially along lines 5—5 of FIG. 1; and FIG. 6 is a greatly enlarged, cross-sectional view taken transversely of the novel weatherstripping of the present invention.

DESCRIPTION OF THE PREFERRED EMBODIMENT

Referring now more particularly to the drawings, in FIGS. 1 and 2 is illustrated an entrance generally referred to by the reference numeral 10 which includes a rectangular door frame 12 in which a door 14 is mounted for pivotal movement on hinges 16 adjacent a vertical side frame member or jamb 18. The frame 12 includes another vertical side frame member 20 on the opposite side and a header 22 interconnecting the vertical jambs 18 and 20 adjacent the upper edge of the door. The door frame also includes a specially designed threshold 24 along the lower edge and attached to the adjacent floor of the entrance opening. The door 14 may be of a more or less conventional type including a vertical pivot stile 26, a verticle lock stile 28 and a pair of upper and lower horizontal frame rails 30 and 32 which interconnect the stiles at upper and lower ends to provide a framework for supporting one or more glass panels 34. A push bar handle 36 spanning the stiles 26 and 28 may be provided on inside and on the outside face of the door is provided with a handle 37. As shown in FIG. 2, the door is mounted to pivot outwardly as indicated by the arrow "A" about a vertical axis extending through the hinges 16.

Each of the door frame members 18, 20 and 22 includes an integral stop element 38 with an outer surface facing the inside surface of the door around the vertical edges and the top or upper horizontal edge. The stops are formed with longitudinally extending key slots or grooves 38*a* (FIG. 6) for retaining elongated, extruded weatherstripping constructed in accordance with the features of the present invention and referred to generally by the reference numeral 40.

The weatherstripping is made of polymeric material and is flexible and resilient with a high resistance to impact forces. In addition, the material is provided with an ultraviolet light stabilizer to insure continued performance under severe weather conditions and the surface of the weatherstripping is smooth and has a low friction coefficient.

In accordance with the present invention, the weatherstripping 40 includes a relatively thin, outwardly convex, inner base 42 having a pair of inwardly extending curved legs 44 and 46 adapted to project into the key way slot 38*a* of a stop element 38 along opposite edges of the opening. The legs 44 and 46 are generally parallel and are deflectable laterally inwardly toward one another to aid in the insertion and seating of the weatherstripping in the key slot. At the inner edge, each of the legs 44 and 46 includes a laterally outwardly extending toe (44*a* and 46*a*, respectively), which toes bear against the base or bottom of the key slot 38*a*. At the outer end, each toe is provided with an enlarged rib (44*b* and 46*b*, respectively), and the ribs wedge against the adjacent surface of the key slot and positively secure the weatherstripping in place.

As illustrated in FIG. 6, the base 42 includes an edge portion 48 along one side extending laterally outwardly of the leg 46 and beyond the adjacent edge of the stop element 38 on the door frame. This laterally, outwardly extending edge portion is provided with an outwardly facing, concave surface so that, as a whole, the base 42 is S-shaped in cross-section. At the outer edge, the edge portion is integrally joined in a reverse turn or hinge portion 50 with a deflectable outer sealing element 52. The reverse turn provides a pivot or serves as a hinged interconnection between the base 42 and the outer sealing element.

The inwardly pivotally deflectable sealing element is S-shaped in cross-section like the base and includes a smooth, gently curved outer sealing surface having a concave portion 54 adjacent the reverse turn or hinge portion 50 and an outwardly facing, convex portion 56 integral therewith. The concave edge portion 54 transitions gently into the outwardly sloping convexly curved portion 56 along one side in the porfile. The deflectable sealing element includes a free outer edge 58 opposite the reverse turn or hinge portion 50 and door contact with the surface adjacent the free edge cause the sealing element to pivotally deflect inwardly as the door 14 is closed.

Sealing between the outer element 52 of the weatherstripping and the facing surface of the door 14 is accomplished mainly at the middle portion 56 on the outer sealing surface and this outwardly convex curved surface provides an especially good weathertight seal along the entire length of the weatherstripping. The outer sealing element and base are relatively stiff because none of the components are planar or flat but instead are curved as described. This results in a relatively strong weatherstipping which is exceptionally well suited for both compressive and wiping type sealing action with little chance of developing kinks or sharp bends in a transverse direction which would permit leakage. For example, the toe portions 44*a* and 46*a* on the legs 44 and 46, and the legs themselves are of a curved cross-sectional shape rather than straight or flat and because of this, these members are much stronger. The base 42 is of an S-shaped profile which includes an outwardly convex central portion and an inwardly concave lateral edge portion 48. Similarly, the deflectable sealing element 52 has a cross-section resembling a shallow S-curve and the outwardly convex sealing portion 56 at the middle of the strip is capable of maintaining sealing integrity over its entire length without buckling, kinking or sharply folding. It should be noted that the deflectable sealing element 52 has no flat parallel inside and outside faces and the S-shaped cross-section thus affords the necessary stiffness while permitting a free inward deflection about the pivot axis adjacent the reverse turn 50 with a relatively small inward compressive sealing force as represented by the arrow "B".

Referring to FIG. 4, a compressive sealing of the weatherstripping 40 occurs on the strip which is mounted on the stop element of the door frame member 20 opposite the door hinges 16 and this type of sealing action is achieved with a relatively low force of compression as represented by the arrow "B". Because of the pivotal deflection with relatively little force, the door is not difficult to fully close and is not held in a partially ajar or open position because of expansive forces exerted by a compressed weatherstripping as is the case in most compressive or sponge types of weatherstripping now on the market.

On the opposite side of the door (FIG. 3), the seal between the door frame member 18 and the pivot stile 26 of the door is a wiping or sliding seal, represented by the arrow "C" and the outwardly convex surface of the sealing element 52 acts as a cam to incur inward deflection of the free outer edge portion 58 toward the dotted position (FIG. 6). A compressive seal is established by pressure in the direction of the arrows "B" in FIGS. 4 and 6 and a sliding or wiping seal is established by the sliding contact pressure as represented by the arrows "C" in FIGS. 3 and 6. Both actions cause the outer sealing element 52 to bodily pivot inwardly about a pivot axis along the reverse turn portion 50 and even though the element is freely pivoted at this portion, the S-curved, cross-sectional profile of the weatherstripping 40 retains the strip in tact over long lengths of sealing engagement without permitting kinks or other types of stress points to develop, a phenomenon which is common in other types of thin flat weatherstripping.

Referring to the weatherstripping 40 on the head 22 of the door frame, a combination of compressive sealing and wiping sealing action takes place as the door is pivoted toward the closed position. The sliding or wiping seal force component is generally in a direction longitudinally of the strip and is concentrated mainly at the end portion of the weatherstripping nearest the pivot stile of the door. Adjacent the opposite or lock stile end of the door, the weatherstripping on the header 22 is subject mainly to a compressive sealing force as indicated by the arrows "B".

From the foregoing, it will be seen that the weatherstripping 40 is exceptionally well suited for compression sealing as well as a wiping or sliding seal action and a single cross-sectional shape is suitable for efficient use with the pivot stile as well as the lock stile of the door and with the upper or header rail of the door. The novel design does not cause difficulty in fully closing the door or opening the door and the relatively smooth, low surface friction, polymeric material with the curved sealing surface prevents the tendency of sticking to the door surface yet still provides a good weathertight seal along the entire length of the strip. As illustrated in FIG. 6 when in a relaxed condition, the weatherstripping 40 has a space between the inwardly facing or back surface of the outer sealing element 52 and the outwardly facing surface of the base portion 42. In this condition, a distance labeled by the arrow "D" is provided between the base of the key slot 38*a* and the outer limit of the mid portion 56 of the sealing surface. The free outer edge 58 of the outer sealing element 52 is spaced outwardly of the base of the key slot 38 by a distance represented by the arrow "E" and is outwardly of the outer face of the stop element 38. However, when the door is fully closed, the free outer edge 58 of the outer-sealing element 52 is deflected to the position shown in dotted lines wherein the free outer edge is spaced outwardly of the base of the key slot 38*a* by a distance represented by the arrow "F". In this condition, the curved lateral edge portion 48 of the base and the concave shaped edge portion 54 of the outer sealing element 52 are stressed and tend to bias the weatherstripping back towards the unstressed position as shown in FIG. 6. This bias force provides an excellent seal engagement between the outer surface portion 56 of the sealing element 52 and the adjacent marginal edge portion of the door surface.

Referring now to FIG. 5, in another aspect of the invention, the entrance system 10 provides for a coplanar fixed weather sealing system around the periphery of the closed door in that the weatherstripping 40 on the door frame side members 17 and 20 and the header 22 are aligned in a common plane. In addition, the door 14 is provided with an extruded channel strip 60 mounted along the lower edge on the inside face which is generally aligned and coplanar with the stop elements 38 of the door frame members. The channel strip 60 is formed with a longitudinally extending downwardly opening key slot 60*a* along the lower edge surface and this key slot provides support for holding an enlarged rib portion 62*a* along the upper edge of a downwardly depending rubber sealing strip 62. The strip 62 is shown in profile in FIG. 5, and has a wedged shaped lower portion or blade which projects downwardly from the lower edge surface of the supporting channel strip 60 to engage and seal against the threshold 24.

The threshold is provided with a vertical stop surface 24*a* generally aligned with the outwardly facing surfaces of the stop elements 38 and this stop surface of the threshold is designed to engage and slightly deflect the lower portion of the sealing strip 62 as shown when the door is closed. Thus, a good weather seal is provided all around the entire periphery of the door when the door is closed and with little resistance to the closing action.

When the door is opened to a position as shown in dotted lines in FIG. 5, the lower edge sealing strip 62 assumes a vertical and generally symmetrical configuration as shown and the lower edge of the strip moves in a path slightly above and out of contact with a relatively flat, mid portion 24*b* of the threshold 24. Thus, the deflectable sealing strip 62 mounted along the lower edge of the door does not interfere with or impede closing of the door and yet still provides an excellent seal when the door is closed with the strip deflected as shown in FIG. 5 with a lower inside surface engaged against the vertical surface 24*a* of the threshold.

The door 14 is thus excellently weather sealed around the entire perimeter in a common plane. The novel profile of the weatherstripping 40 prevents kinking or buckling and in combination with the coplanar stop elements 38 provides an excellent weathered entrance.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. An elongated weatherstripping for sealing against a hingedly mounted closure member around the periphery thereof and adapted to be mounted to extend longitudinally along one or more stop elements of a frame in facing relation with one side face of said hinged closure member; said weatherstripping comprising:

a body of flexible material having an inner portion including a base and key means adapted to be secured to a stop element on said frame and an edge portion of said base projecting laterally outwardly along one edge of and in overlapping relation with said stop element beyond said key means along one edge thereof, said base of outwardly convex transverse cross-section facing away from said key means; and a deflectable outer sealing element of flexible material integral with said body and pivotally joined to said base along an outer edge of said laterally projecting edge portion in a reverse turn, said sealing element of outwardly convex transverse cross-section having an outwardly facing curved sealing surface adapted to seal against said one side face of said closure member when said member is in a closed position with respect to said frame, said surface extending outwardly from said reverse turn toward said closure member adjacent a mid portion thereof and said outer sealing element being deflectable inwardly toward said body upon pivotal movement resulting from inward contact and sliding lateral contact with said closure member when said member is pivotally moving toward said closed position with respect to said frame, said outer sealing element including an inwardly deflectable free edge opposite said reverse turn.

2. The elongated weatherstripping of claim 1 wherein said free edge of said deflectable outer sealing element projects laterally outwardly beyond an adjacent edge of said body opposite said one edge thereof.

3. The elongated weatherstripping of claim 1 wherein said free edge of said deflectable outer sealing element is deflected inwardly of said mid portion thereof when said mid portion is in sealed engagement with said closure member.

4. The elongated weatherstripping of claim 1 wherein said outwardly facing sealing surface is curved convexly outward between said free edge and said reverse turn.

5. The elongated weatherstripping of claim 1 wherein said outwardly facing sealing surface is curved concavely inward between said reverse turn and said mid portion.

6. The elongated weatherstripping of claim 1 wherein said reverse turn comprises approximately 180° curvature between adjacent portions of said body and said sealing element.

7. The elongated weatherstripping of claim 1 wherein said body and sealing element are formed of an integral extrusion.

8. The elongated weatherstripping of claim 1 wherein said key means includes a pair of laterally spaced, inwardly extending deflectable legs having laterally outwardly extending toes along the inner edges for engaging edge walls of a key slot in a stop element of said frame.

9. The elongated weatherstripping of claim 8 wherein said legs are spaced laterally inwardly with respect to said reverse turn and said free edge of said sealing element.

10. In combination, an entrance system for an opening in a building wall comprising:

a frame having a pair of uprights interconnected adjacent their upper ends with a header and a threshold between the lower ends of the uprights;

a door mounted for pivotal movement along a pivot axis adjacent and parallel of one of said uprights and including an inside sealing face around a peripheral edge portion for sealing engagement with said frame when said door is closed; and weatherstripping means in accordance with claim 1 adjacent the peripheral edge of said door between said frame and said door when said door is in a closed position, said weatherstripping means mounted on stop elements of said frame on said uprights and said header, said sealing elements of said weatherstripping means engageable to seal with said door and sealing means coplanar therewith attached on said door engageable with said threshold.

11. The entrance system of claim 10 wherein said stop elements on said uprights and said header include longitudinal slots facing said sealing face of said door when in a closed position with said key means of said weatherstripping means seated in said slots, and said outer sealing elements of said weatherstripping means deflectable toward and away from said door sealing face pivotal about an axis parallel of said slots.

12. The entrance system of claim 10 wherein said threshold includes an upstanding stop surface and said door attached sealing means includes a deflectable, downwardly extending portion which is engaged against the stop surface with said portion in a deflected position when said door is closed.

13. The entrance system of claim 10 wherein said reverse turn of said weatherstripping means on said uprights are positioned along edges of stop elements facing toward each other on said door frame.

14. The entrance system of claim 13 wherein said reverse turn of said weatherstripping means on said header is mounted to face downwardly toward said threshold.

* * * * *